US005759752A

United States Patent [19]

Uyttendaele et al.

[11] Patent Number: 5,759,752

[45] Date of Patent: Jun. 2, 1998

[54] DIRECT THERMAL IMAGING MATERIAL CONTAINING A PROTECTIVE LAYER

[75] Inventors: Carlo Uyttendaele, Berchem; Geert Defieuw, Kessel-Lo, both of Belgium

[73] Assignee: AGFA-Gevaert N.V., Mortsel, Belgium

[21] Appl. No.: 563,855

[22] Filed: Nov. 29, 1995

Related U.S. Application Data

[63] Continuation of Ser. No. 328,542, Oct. 25, 1994, abandoned, which is a continuation of Ser. No. 206,438, Mar. 4, 1994, abandoned.

[30] Foreign Application Priority Data

Mar. 8, 1993 [EP] European Pat. Off. ..... 93200653

[51] Int. Cl.[6] ..... G03C 1/498

[52] U.S. Cl. ..... 430/350; 430/200; 430/203; 430/523; 430/617; 428/913

[58] Field of Search ..... 430/523, 533, 430/617, 619, 964, 203, 200; 428/913, 350

[56] References Cited

U.S. PATENT DOCUMENTS

| | | | |
|---|---|---|---|
| 3,074,809 | 1/1963 | Owen | 430/616 |
| 3,080,254 | 3/1963 | Grant, Jr. | 430/616 |
| 4,982,014 | 1/1991 | Freitag et al. | 568/721 |

OTHER PUBLICATIONS

Research Disclosure 10148, 1972.

Disclosed Anonymously (R1278), Research Disclosure 10147, Sep. 1972.

*Primary Examiner*—Thorl Chea

*Attorney, Agent, or Firm*—Baker & Botts, L.L.P.

[57] ABSTRACT

A thermosensitive recording material suited for use in direct thermal imaging by means of an information-wise energized heating element, said recording material containing a thermosensitive recording layer of which the optical density is changed by heat, characterized in that said recording layer is coated with a protective transparent resin layer essentially consisting of a polycarbonate or copolycarbonate derived from one or more bisphenols, wherein at least 25 mole % of said bisphenols consists of a bis-(hydroxyphenyl)-cycloalkane corresponding to following general formula (I):

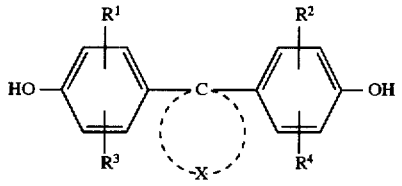

(I)

wherein:

each of $R^1$, $R^2$, $R^3$, and $R^4$ (same or different) represents hydrogen, halogen, a $C_1$–$C_8$ alkyl group, a substituted $C_1$–$C_8$ alkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group, and X represents the atoms necessary to complete a 5- to 8-membered alicyclic ring, which either carries at least one $C_1$–$C_6$ alkyl group or at least one 5- or 6-membered cycloalkyl group, or carries a fused-on 5- or 6-membered cycloalkyl group.

16 Claims, No Drawings

DIRECT THERMAL IMAGING MATERIAL CONTAINING A PROTECTIVE LAYER

This application is a continuation of application Ser. No. 08/328,542, filed on Oct. 25, 1994, now abandoned, which is a file-wrapper continuation of application Ser. No. 08/206,438, filed on Mar. 4, 1994, now abandoned.

DESCRIPTION

1. Field of the invention

The present invention relates to a recording material suited for use in direct thermal imaging.

2. Background of the Invention

Thermal imaging or thermography is a recording process wherein images are generated by the use of imagewise modulated thermal energy.

In thermography two approaches are known:

1. Direct thermal formation of a visible image pattern by imagewise heating of a recording material containing matter that by chemical or physical process changes colour or optical density.

2. Thermal dye transfer printing wherein a visible image pattern is formed by transfer of a coloured species from an imagewise heated donor element onto a receptor element.

Thermal dye transfer printing is a recording method wherein a dye-donor element is used that is provided with a dye layer wherefrom dyed portions or incorporated dye is transferred onto a contacting receiver element by the application of heat in a pattern normally controlled by electronic information signals.

A survey of "direct thermal" imaging methods is given e.g. in the book "Imaging Systems" by Kurt I. Jacobson-Ralph E. Jacobson, The Focal Press—London and New York (1976), Chapter VII under the heading "7.1 Thermography". Thermography is concerned with materials which are substantially not photosensitive, but are sensitive to heat or thermosensitive. Imagewise applied heat is sufficient to bring about a visible change in a thermosensitive imaging material.

Most of the "direct" thermographic recording materials are of the chemical type. On heating to a certain conversion temperature, an irreversible chemical reaction takes place and a coloured image is produced.

A wide variety of chemical systems has been suggested some examples of which have been given on page 138 of the above mentioned book of Kurt I. Jacobson et al., describing the production of a silver metal image by means of a thermally induced oxidation-reduction reaction of a silver soap with a reducing agent.

According to U.S. Pat. No. 3,080,254 a typical heat-sensitive copy paper includes in the heat-sensitive layer a thermoplastic binder, e.g ethyl cellulose, a water-insoluble silver salt, e.g. silver stearate and an appropriate organic reducing agent, of which 4-methoxy-1-hydroxy-dihydronaphthalene is a representative. Localized heating of the sheet in the thermographic reproduction process, or for test purposes by momentary contact with a metal test bar heated to a suitable conversion temperature in the range of about 90°–150° C., causes a visible change to occur in the heat-sensitive layer. The initially white or lightly coloured layer is darkened to a brownish appearance at the heated area. In order to obtain a more neutral colour tone a heterocyclic organic toning agent such as phthalazinone is added to the composition of the heat-sensitive layer. Thermo-sensitive copying paper is used in "front-printing" or "back-printing" using infra-red radiation absorbed and transformed into heat in contacting infra-red light absorbing image areas of an original as illustrated in FIGS. 1 and 2 of U.S. Pat. No. 3,074,809.

As described in "Handbook of Imaging Materials", edited by Arthur S. Diamond—Diamond Research Corporation—Ventura, Calif., printed by Marcel Dekker, Inc. 270 Madison Avenue, New York, N.Y. 10016 (1991), p. 498–499 in thermal printing image signals are converted into electric pulses and then through a driver circuit selectively transferred to a thermal printhead. The thermal printhead consists of microscopic heat resistor elements, which convert the electrical energy into heat via the Joule effect. The electric pulses thus converted into thermal signals manifest themselves as heat transferred to the surface of the thermal paper wherein the chemical reaction resulting in the formation of a visible image takes place.

According to the last mentioned book (ref. p. 499–551) in the past several systems were developed for direct thermal imaging of which the leuco dye system has found commercial use. Optical density obtained with embodiments of said system is usually not higher than 2 and requires mixtures of leuco dye compounds to produce black.

The heat-sensitive copying papers including a recording layer having a substantially light-insensitive organic silver salt and organic reducing agent in a thermoplastic binder such as polyvinyl acetate and polyvinyl butyral are less suited for use in thermographic recording operating with thermal printheads since these recording layers may stick to said printheads. Moreover, organic ingredients may leave the thermosensitive recording layer on heating and soil the thermal printhead at an operating temperature in the range of 300° to 400° C. which are temperatures common in using thermal printheads (ref.the above mentioned book "Handbook of Imaging Materials", p. 502). The undesirable transfer of said ingredients may be promoted by the pressure contact of the thermal printhead with the recording material. Possible contact-pressures may be 200–500 g/cm$^2$ to ensure a good transfer of heat. The heating time per picture element (pixel) may be less than 1.0 ms.

Objects and Summary of the Invention

It is an object of the present invention to provide a thermosensitive recording material suited for use in direct thermal imaging, wherein the thermosensitive imaging layer of said material is effectively protected without substantial loss in imaging properties such as sensitivity and image resolution.

It is a particular object of the present invention to provide a thermosensitive recording material suited for use in direct thermal imaging, wherein the thermosensitive imaging layer of said material is coated with a protective layer that when contacted with an imagewise energized heating element does not deform and does not stick thereto and that prevents soiling of the heating element.

Other objects and advantages of the present invention will appear from the further description.

According to the present invention a thermosensitive recording material suited for use in direct thermal imaging by means of an information-wise energized heating element is provided, which recording material comprises on the same side of a support, called the heat-sensitive side, one or more layers containing in thermal working relationship one or more substances yielding an optical density change by heat, characterized in that one of said recording layers is coated with a protective transparent resin layer essentially consisting of a polycarbonate or copolycarbonate derived from one or more bisphenols, wherein at least 25 mole % of said bisphenols consists of a bis-(hydroxyphenyl)-cycloalkane corresponding to following general formula (I):

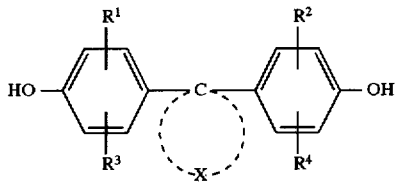

(I)

wherein:

each of $R^1$, $R^2$, $R^3$, and $R^4$ (same or different) represents hydrogen, halogen, a C1–C8 alkyl group including a substituted C1–C8 alkyl group, a C5–C6 cycloalkyl group including a substituted C5–C6 cycloalkyl group., C6–C10 aryl group including a substituted C6–C10 aryl group or a C7–C12 aralkyl group including a substituted C7–C12 aralkyl group; and X represents a plurality of atoms necessary to complete a 5- to 8-membered alicyclic ring, which either is attached to at least one C1–C6 alkyl group or at least one 5- or 6-membered cycloalkyl group, or is attached to a fused-on 5- or 6-membered cycloalkyl group.

The present invention includes also the use of said recording material in direct thermal imaging.

By "thermal working relationship" is meant here that said substances may be present in a same layer or different layers wherefrom by heat they can come into reactive contact with each other, e.g. by diffusion or mixing in the melt. The layer in which the optical density change takes place is called the recording layer.

DETAILED DESCRIPTION OF THE INVENTION

Homopolycarbonates derived from bis-(hydroxyphenyl)-cycloalkanes corresponding to general formula (I) can have a glass transition temperature of about 260° C., which is substantially higher than the Tg of homopolycarbonates derived from bisphenol A that have a Tg of only about 150° C.

By copolycondensation with other bisphenols than the bisphenols according to said general formula (I) the Tg can be varied e.g. between 180 and 240 ° C.

Protective layers containing (co)polycarbonates derived from bis-(hydroxyphenyl)-cycloalkanes corresponding to general formula (I) show better heat-stability, e.g. less deformation, than heat-resistant layers containing conventional polymeric thermoplasts.

The homopolycarbonates derived from bis-(hydroxyphenyl)-cycloalkanes corresponding to said general formula (I) are soluble in ecologically acceptable solvents such as ethyl methyl ketone and ethyl acetate which is not the case with polycarbonates derived from bisphenol A.

For increasing the solubility in said solvents preferably one or two carbon atoms of said alicyclic ring in said general formula (I) carry a C1–C6 alkyl group, e.g. a methyl group.

Bisphenol compounds according to said general formula (I) are preferred wherein said alicyclic ring is substituted with two C1–C6 alkyl groups, at ring carbon atom(s) two carbon atoms removed from the carbon atom at which said hydroxyphenyl-groups are attached to said alicyclic group.

Bis-(hydroxyphenyl)-cycloalkanes corresponding to said general formula (I), which are preferably used for preparing polycarbonates applied according to the present invention correspond to one of the following structural formulae (II) to (IV)

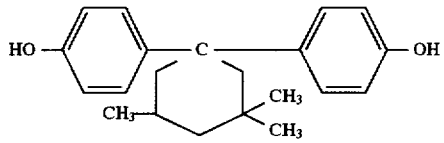

(II)

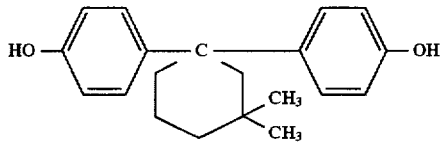

(III)

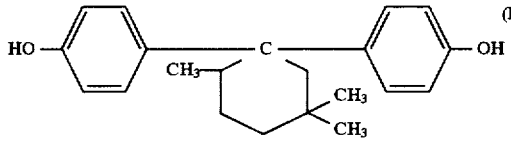

(IV)

A particularly preferred bis-(hydroxyphenyl)-cycloalkane for use in the preparation of a polycarbonate intended for coating a protective layer on a direct thermal recording layer is 1,1-bis-(4-hydroxyphenyl)-3,3,5-trimethylcyclohexane [see formula (II)].

The bis-(hydroxyphenyl)-cycloalkanes corresponding to general formula (I) can be prepared according to a known method by condensation of phenols corresponding to general formula (V) and ketones corresponding to general formula (VI)

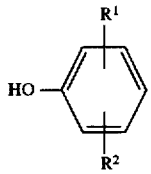

(V)

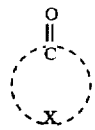

(VI)

wherein $R^1$, $R^2$, and X have the same significances as given to them in general formula (I).

Examples of suitable phenols corresponding to general formula (V) are i.a. phenol, o-cresol, m-cresol, 2,6-dimethylphenol, 2-chlorophenol, 3-chlorophenol, 2,6-dichlorophenol, 2-cyclohexyl-phenol, diphenylphenol, and o- or p-benzylphenol.

Most of these phenols are commercially available and can be prepared according to known methods (see e.g. for the preparation of cresols and xylenols "Ullmanns Encyklopadie der technischen Chemie" 4. neubearbeitete und erweiterte Auflage, Band 15, pages 61 to 77, Verlag Chemie-Weinheim-New York 1978. For the preparation of chlorophenols see "Ullmanns Encyklopadie der technischen Chemie" 4. Auflage, Band 9, pages 573 to 582, Verlag Chemie 1975. For the preparation of alkylphenols see "Ullmanns Encyklopadie der technischen Chemie" 4. Auflage, Band 18, pages 191 to 214, Verlag Chemie 1979).

Ketones corresponding to general formula (VI) are prepared e.g. according to methods described in Beilsteins Handbuch der Organischen Chemie, 7. Band, 4. Auflage, Springer-Verlag, Berlin, 1925 and corresponding Erg änzungsbande 1–4; Journal of American Chemical Society, Vol. 79 (1957), pages 1488, 1490 and 1491; US 2,692,289; Journal of Chemical Society, 1954, pages 2186 and 2191; Journal of Organic Chemistry, Vol. 38, No. 26, 1973, page 4431; Journal of American Chemical Society, Vol. 87, 1965, page 1353 (especially page 1355). A general method for preparing ketones within said formula (VI) is given in Organikum, 1.5. Auflage, 1977, VEB-Deutscher Verlag der Wissenschaften, Berlin, page 698.

Examples of suitable ketones corresponding to general formula (VI) are: 3,3-dimethylcyclopentanone, 2,2-dimethylcyclohexanone, 3,3-dimethylcyclohexanone, 4,4-dimethylcyclohexanone, 3-ethyl-3-methylcyclopentanone, 2,3,3-trimethylcyclopentanone, 2,4,4-trimethylcyclopentanone, 3,3,4-trimethylcyclopentanone, 3,3-dimethylcycloheptanone, 4,4-dimethylcycloheptanone, 3-ethyl-3-methylcyclohexanone, 4-ethyl-4-methylcyclohexanone, 2,3,3-trimethylcyclohexanone, 2,4,4-trimethylcyclohexanone, 3,3,4-trimethylcyclohexanone, 2,5,5-trimethylcyclohexanone, 3,3,5-trimethylcyclohexanone, 3,4,4-trimethylcyclohexanone, 2,3,3,4-tetramethylcyclopentanone, 2,3,4,4-tetramethylcyclopentanone, 3,3,4,4-tetramethylcyclopentanone, 2,2,5-trimethylcycloheptanone, 2,2,6-trimethylcycloheptanone, 2,6,6-trimethylcycloheptanone, 3,3,5-trimethylcycloheptanone, 3,5,5-trimethylcycloheptanone, 5-ethyl-2,5-dimethylcycloheptanone, 2,3,3,5-tetramethylcycloheptanone, 2,3,5,5-tetramethylcycloheptanone, 3,3,5,5-tetramethylcycloheptanone, 4-ethyl-2,3,4-trimethylcyclopentanone, 2-isopropyl-4,4-dimethylcyclopentanone, 4-isopropyl-2,4-dimethylcyclopentanone, 2-ethyl-3,5,5-trimethylcyclohexanone, 3-ethyl-3,5,5-trimethylcyclohexanone, 3-ethyl-4-isopropyl-3-methylcyclopentanone, 4-s-butyl-3,3-dimethylcyclopentanone, 2-isopropyl-3,3,4-trimethylcyclopentanone, 3-ethyl-4-isopropyl-3-methylcyclohexanone, 4-ethyl-3-isopropyl-4-methylcyclohexanone, 3-s-butyl-4,4-dimethylcyclohexanone, 3-isopropyl3,5,5-trimethylcyclohexanone, 4-isopropyl-3,5,5-trimethylcyclohexanone, 3,3,5-trimethyl-5-propylcyclohexanone, 3,5,5-trimethyl-5-propylcyclohexanone, 2-butyl-3,3,4-trimethylcyclopentanone, 2-butyl-3,3,4-trimethylcyclohexanone, 4-butyl-3,3,5-trimethylcyclo-hexanone, 3-isohexyl-3-methylcyclohexanone, 5-ethyl-2,4-diisopropyl-5-methylcyclohexanone, 2,2-dimethylcyclooctanone, and 3,3,8-trimethylcyclo-octanone.

Examples of preferred ketones are:

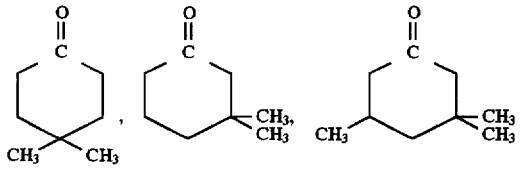

-continued

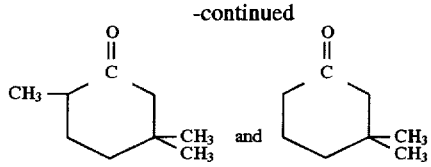

The synthesis of some bis-(hydroxyphenyl)-cycloalkanes corresponding said general formula (I) is described in German patent 3 832 396.

In the preparation of high molecular weight, thermoplastic, aromatic copolycarbonates for use according to the present invention the bis-(hydroxyphenyl)-cycloalkanes corresponding to general formula (I) can also advantageously be used in combination with other bisphenol compounds corresponding to the following general formula:

$$HO—Z—OH \qquad (VII)$$

wherein Z stands for a bivalent organic group comprising one or more aromatic nuclei in which the two OH groups of said general formula are either both attached to a single aromatic nucleus, or, the OH-groups are linked to two different aromatic nuclei, in the latter case said two different aromatic nuclei must be linked directly or through a bivalent radical different from the group CX mentioned in general formula (I), e.g. Z represents —O—, —S—, carbonyl, sulfinyl, sulfonyl or a bivalent straight chain or branched cain aliphatic group or bivalent unsubstituted cycloaliphatic group.

Examples of compounds corresponding to said general formula (VII) are i.a. hydroquinone, resorcinol, dihydroxydiphenyl, bis-(hydroxy-phenyl)-alkanes, bis-(hydroxyphenyl)-cyclohexane, bis-(hydroxy-phenyl)-sulfide, bis-(hydroxyphenyl)-ether, bis-(hydroxyphenyl)-ketone, bis-(hydroxyphenyl)-sulfone, bis-(hydroxyphenyl)-sulfoxide, α,α-bis- (hydroxyphenyl)-diisopropylbenzene, and such compounds carrying at least one alkyl and/or halogen substituent on the aromatic nucleus.

These and other suitable compounds corresponding to general formula (VII) are described in e.g. U.S. Pat. No. 3,028,365, U.S. Pat. No. 2,999,835, U.S. Pat. No. 3,148,172, U.S. Pat. No. 3,275,601, U.S. Pat. No. 2,991,273, U.S. Pat. No. 3,271,367, U.S. Pat. No. 3,062,781, U.S. Pat. No. 2,970,131, U.S. Pat. No. 2,999,846, DE 1,570,703, DE 2,063,050, DE 2,063,052, DE 2,211,956, FR 1,561,518, and in "Chemistry and Physics of Polycarbonates", Interscience Publishers, New York, 1964.

Preferred compounds corresponding to said general formula (VII) are i.a. 4,4,'-dihydroxydiphenyl, 2,2-bis-(4-hydroxyphenyl)-propane, 2,4-bis-(4-hydroxyphenyl)-2-methylbutane, 1,1-bis-(4-hydroxyphenyl)-cyclohexane, α,α'-bis-(4-hydroxyphenyl)-p-diisopropyl-benzene, 2,2-bis-(3-methyl-4-hydroxyphenyl)-propane, 2,2-bis-(3-chloro-4-hydroxyphenyl)-propane, bis-(3,5-dimethyl-4-hydroxyphenyl)-methane, 2,2-bis-(3,5-dimethyl-4-hydroxyphenyl)-propane, bis-(3,5-dimethyl-4-hydroxyphenyl)-sulfone, 2,4-bis-(3,5-dimethyl-4-hydroxyphenyl)-2-methylbutane, 1,1-bis-(3,5-dimethyl-4-hydroxyphenyl)-cyclohexane, α,α'-bis-(3,5-dimethyl-4-hydroxyphenyl)-p-diisopropylbenzene, 2,2-bis-(3,5-dichloro-4-hydroxyphenyl)-propane, 2,2-bis-(3,5-dibromo-4-hydroxyphenyl)-propane, 2,2-bis-(4-hydroxyphenyl)-propane, 2,2-bis-(3,5-dimethyl-4-hydroxyphenyl)-propane, 2,2-bis-(3,5-dichloro-4-hydroxy-phenyl)-propane, 2,2-bis-(3,5-dibromo-4-hydroxyphenyl)-propane, and 1,1-bis-(4-hydroxyphenyl)-cyclohexane. Most preferred is 2,2-bis-(4-hydroxyphenyl)-propane (bisphenol A).

Incorporation of bisphenol A in the polycarbonate for use according to the present invention reduces the brittleness of the polycarbonate but such at the expense of a lower Tg. A lower brittleness makes the protective layer less scratchable. A compromise may be found between scratchability and deformability by heat.

When in the preparation of the above mentioned copolycarbonates the bis-(hydroxyphenyl)-cycloalkanes corresponding to general formula (I) are used together with at least one bisphenol compound corresponding to general formula (VII); the amount of bis-(hydroxyphenyl)-cycloalkanes corresponding to said general formula (I) is preferably at least 25 mole %, more preferably at least 50 mole % with regard to the totality of bisphenols.

The bis-(hydroxyphenyl)-cycloalkane units and the units resulting from the compounds corresponding to general formula (VII) can be present in the copolycarbonates in different blocks or the different units can be distributed randomly.

In the preparation of (co)polycarbonates for use according to the present invention a branching agent may be used to still further increase the Tg and mechanical resistance. Small amounts, preferably from 0.05 to 2.0 mol % (in respect of the bis-(hydroxyphenyl)-cycloalkane) of tri- or higher functional compounds, in particular compounds having three or more phenolic groups, can be added to obtain branched (co)polycarbonates. Useful branching agents having three or more phenolic groups are i.a. phloroglucinol, 4,6-dimethyl-2,4,6-tri-(4-hydroxyphenyl)-heptene-2, 4,6-dimethyl-2,4,6-tri-(4-hydroxyphenyl)-heptane, 1,3,5-tri-(4-hydroxyphenyl)-benzene, 1,1,1-tri-(4-hydroxyphenyl)-ethane, tri-(4-hydroxyphenyl)-phenylmethane, 2,2-bis-(4,4-bis-(4-hydroxyphenyl)-cyclohexyl)-propane, 2,4-bis-(4-hydroxyphenyl-isopropyl)-phenol, 2,6-bis-(2-hydroxy-5'-methyl-benzyl)-4-methylphenol, 2-(4-hydroxyphenyl)-2-(2,4-dihydroxyphenyl)-propane, orthoterephthalic acid hexa-(4-(4-hydroxyphenyl)-isopropyl)-phenyl) ester, tetra-(4-hydroxyphenyl)-methane, tetra-(4-(4-hydroxyphenyl-isopropyl)-phenoxy)-methane, and 1,4-bis-((4'-4v!-dihydroxytriphenyl)-methyl)-benzene.

Examples of other trifunctional compounds are i.a. 2,4-dihydroxy-benzoic acid, trimesic acid, cyanuric chloride, and 3,3-bis-(3-methyl-4-hydroxyphenyl)-2-oxo-2,3-dihydroindole.

For terminating the chain elongation and controlling the molecular weight of the (co)polycarbonates use can be made of monofunctional compounds known in the art. Suitable compounds for said purpose are e.g. phenol, t-butylphenol, and other C1–C7-alkyl-substituted phenols. Particularly small amounts of phenols corresponding to the following general formula (VIII) are useful in this respect :

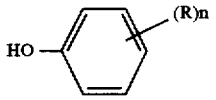

(VIII)

wherein

R represents at least one substituent chosen from branched $C_8$-alkyl groups and branched C9-alkyl groups, and n is 1, 2, 3, 4, or 5; in case n is 2 to 5 the R groups may have a same or different significance.

Preferably the contribution of $CH_3$-protons in the alkyl group(s) R is between 47 and 89 % and the contribution of CH— and $CH_2$-protons is between 53 and 11%. Preferably, the alkyl group(s) R is (are) situated in o- and/or p-position with respect to the OH-group, and in particular the ortho substitution amounts to at the most 20%. The compounds used to terminate the chain elongation are in general used in concentrations of 0.5 to 10, preferably 1.5 to 8 mol % with respect to the content of the bis-(hydroxyphenyl)-cycloalkanes corresponding to general formula (I).

The (co)polycarbonates for use according to the present invention can be prepared according to the interfacial polycondensation method as known in the art (see e.g. H. Schnell, "Chemistry and Physics of PolycarbonatesIY, Polymer Reviews, Vol. IX, page 33, Interscience Publ., 1964). According to this method the bisphenols are dissolved in aqueous alkaline phase. In order to control the molecular weight compounds terminating the chain elongation may be added (e.g. compounds corresponding to the general formula VIII). The condensation reaction takes place in the presence of an inert organic phase containing phosgene. Preferably as inert organic phase a water-immiscible solvent is used which is a solvent for the (co)polycarbonate formed. The reaction temperature is preferably between 0° C. and 40° C.

If branching agents are used, they can be added in an amount of 0.05 to 2 mol % to the aqueous alkaline phase together with the bis-(hydroxyphenyl)-cycloalkanes and other diphenols or they can be added to the organic phase before phosgenation takes place.

In addition to the bis-(hydroxyphenyl)-cycloalkanes and other diphenols also their mono- and/or bis-chlorocarbonate esters can be used, added in the form of a solution in an organic solvent. The amount of chain-terminating agent and branching agent is then levelled against the amount of bis-(hydroxyphenyl)-cycloalkane and other diphenol structural units. When chlorocarbonate esters are used, the amount of phosgene can be reduced as known in the art.

Suitable organic solvents for dissolving the chain-terminating agent, the branching agent, and the chlorocarbonate ester are e.g. methylene chloride, chlorobenzene, acetone, acetonitrile, and mixtures of these solvents, in particular mixtures of methylene chloride and chlorobenzene. Optionally, the chain-terminating agent and the branching agent are dissolved in the same solvent.

As organic phase for the interfacial condensation are used e.g. methylene chloride, chlorobenzene and mixtures of methylene chloride and chlorobenzene.

As aqueous alkaline phase are used e.g. aqueous sodium hydroxide solutions.

The preparation of polycarbonates according to the interfacial polycondensation method can be catalyzed as known in the art by adding catalysts such as tertiary amines, in particular tertiary aliphatic amines such as tributylamine or triethylamine; the catalysts are used in amounts of from 0.05 to 10 mol % in respect of the content of bis-(hydroxyphenyl)-cycloalkanes and other diphenols. The catalysts can be added before the start of the phosgenation, during the phosgenation, or after the phosgenation.

The isolation of the (co)polycarbonates is performed as known in the art.

The (co)polycarbonates for use according to the present invention can also be prepared in homogeneous phase according to a known method (the so-called pyridine method) or according to the known melt ester-interchange process by using e.g. diphenyl carbonate instead of phosgene. In this case as well, the (co)polycarbonates are isolated according to methods known in the art.

Preferably, the molecular weight of the (co) polycarbonates is at least 8000, preferably from 8000 to 200,000 and more preferably from 10,000 to 80,000.

Examples of polycarbonates that can be used advantageously in accordance with the present invention are i.a.:

PC1 Homopolycarbonate having the following structure:

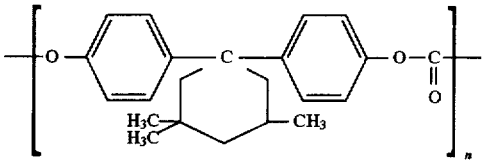

wherein n has a value giving the polymer a viscosity ratio of 1.295 as determined for a 0.5% wt solution of the polymer in dichloromethane. The viscosity ratio is by definition the quotient of the viscosity of the polymer solution and of the pure solvent measured at the same temperature, here 20° C.

PC2 Homopolycarbonate having the same structure as PC1 but giving a viscosity ratio of 2.2.

Pc3 Copolycarbonate having the following structure:

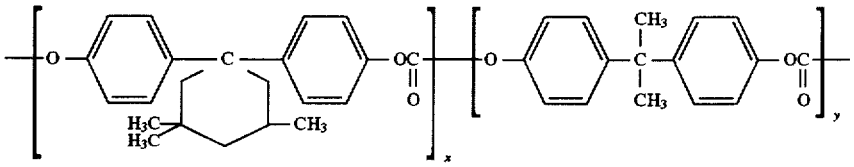

wherein x=55 mol % and y=45 mol % ; giving a viscosity ratio of 1.295.

A mixture of two or more of different (co)polycarbonates may be used in the heat-resistant layer.

The protective layer of the direct thermal recording material according to the present invention may in addition to said (co)polycarbonates contain one or more of the thermoplastic binders commonly used for heat-resistant layers such as e.g. poly(styrene-co-acrylonitrile), poly(vinyl alcohol-co-butyral), poly(vinyl alcohol-co-acetal), poly(vinyl alcohol-co-benzal), polystyrene, poly(vinyl acetate), cellulose nitrate, cellulose acetate propionate, cellulose acetate hydrogen phthalate, cellulose acetate, cellulose acetate butyrate, cellulose triacetate, ethyl cellulose, poly(methyl methacrylate), and copolymers of methyl methacrylate. The addition of poly(styrene-co-acrylo-nitrile) is preferred. The protective layer applied according to the present invention may contain additives provided such materials do not inhibit its anti-sticking properties and provided that such materials do not scratch, erode, contaminate, or otherwise damage the thermal printing head or harm image quality. The protective layer of the direct thermal recording material according to the present invention may comprise or is coated with minor amounts of such other agents like liquid lubricants. Examples of suitable lubricating materials are surface active agents with or without a polymeric binder. The surface active agents may be any agents known in the art having a hydrophobic molecule part in conjunction with (a) polar group(s) such as carboxylate, sulfonate, phosphates, aliphatic amine salt, aliphatic quaternary ammonium salt groups, polyoxyethylene alkyl ethers, polyethylene glycol fatty acid esters, and fluoroalkyl C2–C20 aliphatic acids. Examples of liquid lubricants include silicone oils, synthetic oils, saturated hydrocarbons and glycols. Preferably, these silicone compounds for forming a topcoat are coated in the form of a solution in a non-solvent for the polycarbonate of the heat-resistant layer e.g. in isopropanol or a $C_6$–$C_{11}$ alkane.

The protective layer has preferably a thickness of about 0.1 to 15 μm, more preferably of 0.5 to 5.0 μm and may be coated on the thermosensitive recording layer means of a known coating technique for thin-layer coating.

Optionally the protective layer according to the present invention is coated with an outermost slipping layer (i.e. anti-sticking layer) compositions of which are described in e.g. EP 138483, EP 227090, U.S. Pat. Nos. 4,567,113, 4,572,860 and 4,717,711 and in published European patent application 311841.

In an example a suitable slipping layer comprises as binder a styrene-acrylonitrile copolymer or a styrene-acrylonitrile-butadiene copolymer or a mixture hereof and as lubricant in an amount of 0.1 to 10% by weight of the binder(s) a polysiloxane-polyether copolymer or polytetrafluoroethylene or a mixture hereof.

Another suitable slipping layer may be obtained by coating a solution of at least one silicon compound and a substance capable of forming during the coating procedure a polymer having an inorganic backbone which is an oxide of a group IVa or IVb element as described in published European patent application 0554576.

Other suitable slipping coatings are described e.g. in published European patent applications (EP-A) 0 501 072 and 0 492 411. A slipping layer may have a thickness of about 0.2 to 5.0 μm, preferably in the range of 0.4 to 2.0 μm.

The thermographic recording material for direct thermal recording and having a recording layer protected with said (co)polycarbonate containing layer as described herein may be of any type known in the art.

For obtaining optical densities above 2 preferably recording materials on the basis of substantially light-insensitive organic silver salts in admixture with a reducing agent therefor in a water-insoluble resin binder are used.

The reducing agent present may be of the type used in known thermographic recording materials for producing a silver image by thermally initiated reduction of substantially light-insensitive silver salts such as silver behenate. Examples of such reducing agents are described in U.S. Pat. No. 3,887,378 and prior art mentioned therein and also in U.S. Pat. Re. No. 30,107 being reissue of U.S. Pat. No. 3,996,397.

Sterically hindered phenols or bis-phenols (ref. U.S. Pat. No. 3,547,648) may be used as auxiliary reducing agents that become on heating reactive partners in the reduction of a light-insensitive silver salt such as silver behenate.

Substantially light-insensitive organic silver salts particularly suited for use in direct thermal recording materials according to the present invention are silver salts of aliphatic carboxylic acids known as fatty acids, wherein the aliphatic carbon chain has at least 12 C-atoms, e.g. silver palmitate, silver stearate and silver behenate, but modified aliphatic carboxylic acids with thioether group as described e.g. in GB-P 1,111,492 may be used likewise to produce a thermally developable silver image.

The silver image density depends on the coverage of the reducing agent(s) and organic silver salt(s) and has to be preferably such that on heating above 100° C. an optical density of at least 3 can be obtained.

Preferably at least 0.10 mole of reducing agent(s) per mole of organic silver salt is used. In particular combinations the fatty acid silver salts are present in combination with the free fatty acids.

The ratio by weight of the resin binder to organic silver salt is e.g. in the range of 0.2 to 6, and the thickness of the recording layer is preferably in the range of 3 to 30 μm, more preferably in the range of 8 to 16 μm. According to a particular embodiment the thermosensitive recording material contains in one layer a substantially light-insensitive organic silver salt and in another layer in thermal working relationship with said silver salt one or more reducing agents therefor.

A heat-sensitive recording material containing silver behenate and 4-methoxy-1-naphthol as reducing agent in adjacent binder layers is described in Example 1 of U.S. Pat. No. 3,094,417.

In order to obtain a neutral black image tone in the higher densities and neutral grey in the lower densities the recording layer contains in admixture with said organic silver salt and reducing agent(s) a so-called toning agent known from thermography or photo-thermography.

Suitable toning agents are the phthalimides and phthalazinones within the scope of the general formulae described in the already mentioned U.S. Pat. Re. No. 30,107. Further reference is made to the toning agents described in U.S. Pat. Nos. 3,074,809, 3,446,648 and 3,844,797. Other useful toning agents are benzoxazine dione compounds, e.g. 3,4-dihydro-2,4-dioxo-1,3,2H-benzoxazine described in U.S. Pat. No. 3,951,660.

In addition to said ingredients the recording layer may contain other additives such as antistatic agents, e.g. non-ionic antistatic agents including a fluorocarbon group as e.g. in $F_3C(CF_2)_6CONH(CH_2CH_2O)$—H, ultraviolet light absorbing compounds, white light reflecting and/or ultraviolet radiation reflecting, pigments, colloidal silica, and/or optical brightening agents.

As binding agent for said ingredients preferably thermoplastic resins are used wherein the ingredients can be dispersed homogeneously or form therewith a solid-state solution. For that purpose all kinds of natural, modified natural or synthetic resins may be used, e.g. cellulose derivatives such as ethylcellulose, cellulose esters, carboxymethylcellulose, starch ethers, galactomannan, polymers derived from α,β-ethylenically unsaturated compounds such as polyvinyl chloride, copolymers of vinyl chloride and vinyl acetate, polyvinyl acetate and partially hydrolyzed polyvinyl acetate, polyvinyl alcohol, polyvinyl acetals, e.g. polyvinyl butyral, copolymers of acrylonitrile and acrylamide, polyacrylic acid esters, polymethacrylic acid esters and polyethylene. A particularly suitable ecologically interesting (halogen-free) binder is polyvinyl butyral.

The above mentioned polymers or mixtures thereof forming the binder in the thermographic recording layer may be used in conjunction with waxes or "heat solvents" also called thermosolvents improving the reaction speed of the redox-reaction at elevated temperature.

By the term "heat solvent" in this invention is meant a non-hydrolyzable organic material which is in solid state in the recording layer at temperatures below 50° C. but becomes a liquid solvent for at least one of the redox-reactants, e.g. the reducing agent for the organic silver salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still other examples of heat solvents have been described in U.S. Pat. Nos. 3,438,776, and 4,740,446, and in published EP-A 0 119 615 and 0 122 512 and DE-A 3 339 810.

The support for the heat-sensitive recording material is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form and may be subbed to improve its adherence to the thereon coated thermo-sensitive recording layer.

The coating of the recording layer composition may proceed by any coating technique known in the art using a solvent or solvent mixture for the coating ingredients. Common coating techniques are described e.g. in Modern Coating and Drying Technology, edited by Edward D. Cohen and Edgar B. Gutoff, (1992) VCH Publishers Inc. 220 East 23rd Street, Suite 909 New York, N.Y. 10010, U.S.A. Suitable coating techniques are screen-printing, gravure, forward and reverse roll coating. Screen-printing, spray coating and gravure coating are used as a precision method for applying very thin coatings with more accuracy than can be achieved with other techniques.

The direct thermal recording material according to the present invention is particularly suited for use in conjunction with an electrically energized thermal printhead.

During recording the thermal printhead makes contact with the protective coating of the direct thermal recording material. The thermal printhead contains tiny selectively electrically energized resistors that may not be soiled and have to be protected against wear.

A survey of printhead requirements is given in the already mentioned Handbook of Imaging Materials, Chapter 11, p. 510–514. Commercially available thermal printheads are e.g. a Fujitsu Thermal Head (FTP-040 MCS001), a TDK Thermal Head F415 HH7-1089, and a Rohm Thermal Head KE 2008-F3.

The information-wise heating may proceed likewise by means of a resistive ribbon wherein an electrical current is injected through tiny printhead electrodes (styli) into a resistive layer (surface resistivity in the range of 500 to 900 ohms/square) coated at the side opposite said electrodes with a continuous electrode, e.g. in the form of vacuum-deposited aluminium layer. A large ground plate electrode aside said printhead electrodes and in contact with the resistive layer ensures that Joule heating is minimized as the current flows to ground (see the already mentioned book "Progress in Basic Principles of Imaging Systems -Proceedings of the International Congress of Photographic Science Köln (Cologne)", (1986) FIG. 6 on page 622 dealing with an embodiment of resistive ribbon printing technology).

The fact that in using a resistive ribbon heat is generated directly in the resistive ribbon and only the travelling ribbon gets hot (not the printheads) an inherent advantage in printing speed is obtained. In applying the thermal printing head technology the various elements of the thermal printing head get hot and must cool down before the head can print without cross-talk in a next position.

The composition and production of a polycarbonate ribbon for non-impact printing (resistive ribbon) is described e.g. in U.S. Pat. No. 4,103,066.

The image signals for modulating the electrical energy to be converted into thermal energy in said thermal printhead or resistive ribbon is obtained directly e.g. from optoelectronic scanning devices or from an intermediary storage means, e.g. magnetic disc or tape or optical disc storage medium, optionally linked to a digital image work station wherein the image information can be processed to satisfy particular needs.

According to still other thermal recording embodiments the present recording material is used in conjunction with an information-wise modulated laser beam or ultrasonic pixel printer as described e.g. in U.S. Pat. No. 4,908,631.

Direct thermal imaging can be used for both the production of transparencies and reflection type prints having an opaque white light reflecting background.

In the hard copy field recording materials on white opaque base, e.g. paper base are used. Said base and/or a layer between the recording layer may contain white light reflecting pigments.

Black-and-white transparencies on colourless or blue base are widely used in the medical diagnostic field in inspection techniques operating with a light box.

The following examples illustrate the present invention without however limiting it thereto. All mentioned percentages and ratios are by weight unless otherwise indicated.

EXAMPLE 1

A subbed polyethylene terephthalate support having a thickness of 100 pm was doctor blade-coated so as to obtain thereon after drying the following recording layer including:

| | |
|---|---|
| silver behenate | 4.47 g/m$^2$ |
| polyvinyl butyral | 2.24 g/m$^2$ |
| reducing agent S as defined hereinafter | 0.85 g/m$^2$ |
| 3,4-dihydro-2,4-dioxo-1,3,2H-benzoxazine | 0.32 g/m$^2$ |
| silicone oil | 0.02 g/m$^2$ |

Reducing agent S is a polyhydroxy spiro-bis-indane, viz. 3,3,3',3'-tetramethyl-5,6,5',6'-tetrahydroxy-spiro-bis-indane.

After drying said recording layer was coated at 22° C. at a wet coating thickness of 30 μm with the following coating composition for forming a protective layer.

| | |
|---|---|
| methyl ethyl ketone | 90 g |
| polycarbonate derived from 45 mole % of bisphenol (II) and 55 mole % of bisphenol A | 10 g |

The thus coated layer was dried for 10 minutes in an air current at 50° C. whereby a protective scratch-resistant layer was obtained.

Onto said protective layer the following coating composition for forming a slipping layer was coated at 22° C. at a wet coating thickness of 30 μm.

| | |
|---|---|
| TEGOGLIDE 410 (tradename) lubricant | 99.5 g |
| isopropanol | 0.50 g |

Said layer was dried as described for the protective layer.

The obtained direct thermal imaging material was used in thermal printing with a thermal printer MITSUBISHI CP100 (tradename). During printing the printhead was kept in contact with the slipping layer and no signs of surface deformation were detected.

The optical densities of the imaged and non-imaged areas were measured in transmission with densitometer MACBETH TD 904 (tradename) provided with an ortho filter (maximal transmission at about 500 nm). The measured minimum optical density ($D_{min}$) was 0.08 and the maximum optical density ($D_{max}$) was 3.3.

EXAMPLE 2

Example 1 was repeated with the difference however that in the protective layer composition the polycarbonate derived from 45 mole % of bisphenol (II) and 55 mole % of bisphenol A was replaced by a polycarbonate derived from 100 mole % of bisphenol (II).

The thus obtained recording material was used in a thermal printer as described in Example 1 and provided same good results.

We claim:

1. A substnatially non-photosensitive thermosensitive recording material suited for use in direct thermal imaging by means of an information-wise energized heating element comprising on the same side of a support, one or more layers containing in thermal working relationship one or more substances yielding an optical density change by heat, and a protective transparent resin layer essentially consisting of a polycarbonate or copolycarbonate derived from one or more bisphenols, wherein at least 25 mole % of said bisphenols consists of a bis-(hydroxyphenyl)-cycloalkane corresponding to following formula (I):

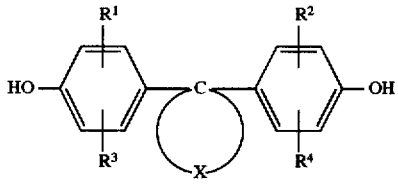

(I)

wherein each of $R^1$, $R^2$, $R^3$, and $R^4$ (same or different) represents hydrogen, halogen, a C1–C8 alkyl group, a substituted C1–C8 alkyl group, a C5–C6 cycloalkyl group, a substituted C5–C6 cycloalkyl group, a C6–C10 aryl group, a substituted C6–C10 aryl group, a C7–C12 aralkyl group, or a substituted C7–C12 aralkyl group, and X represents a plurality of atoms necessary to complete a 5- to 8-membered alicyclic ring, which either is attached to at least one C1–C6 alkyl group or at least one 5- or 6-membered cycloalkyl group.

2. The thermosensitive recording material according to claim 1, wherein in said general formula (I) one or two carbon atoms of said alicyclic ring carry a C1–C6 alkyl group.

3. The substantially non-photosensitive thermosensitive recording material according to claim 1, wherein said alicyclic ring is substituted with two C1–C6 alkyl groups at ring carbon atom(s) which are two carbon atoms removed from a carbon atom at which said hydroxyphenyl-groups are attached to said alicyclic group.

4. The thermosensitive recording material according to claim 1, wherein a bis-(hydroxyphenyl)-cycloalkane according to said formula (I) corresponds to one of following formulae (II) to (IV):

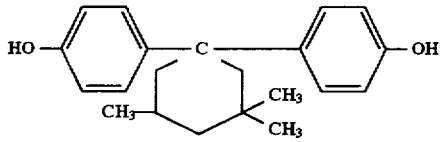

(II)

-continued

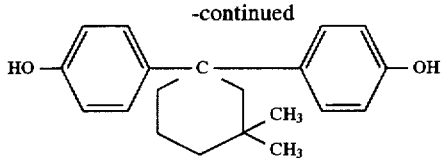

(III)

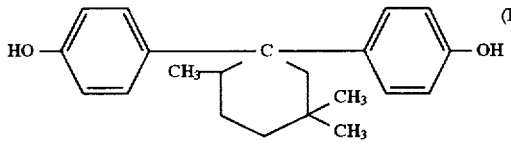

(IV)

5. The substantially non-photosensitive thermosensitive recording material according to claim 1, wherein a copolycarbonate is derived from a bisphenol according to said formula (I) and a bisphenol corresponding to the following general formula:

HO—Z—OH (VII)

wherein Z stands for a bivalent organic group comprising one or more aromatic nuclei in which the two OH— groups of said general formula (VII) are either both attached to a single aromatic nucleus, or the OH-groups are linked to two different aromatic nuclei, in the latter case said two different aromatic nuclei must be linked directly or through a bivalent radical selected from the group consisting of —O—, —S—, carbonyl, sulfinyl, sulfonyl or a bivalent straight chain or branched chain aliphatic group or bivalent unsubstituted cycloaliphatic group.

6. The substantially non-photosensitive thermosensitive recording material according to claim 5, wherein said bisphenol according to formula (VII) is 2,2-bis-(4-hydroxyphenyl)-propane.

7. The substantially non-photosensitive thermosensitive recording material according to claim 5, wherein the copolycarbonate further comprises a branching agent having three or more phenolic groups.

8. The substantially non-photosensitive thermosensitive recording material according to claim 1, wherein said protective transparent layer contains a liquid lubricant.

9. The substantially non-photosensitive thermosensitive recording material according to claim 1, wherein said one or more layers contains a substantially light-insensitive organic silver salt in admixture with a reducing agent therefor.

10. The substantially non-photosensitive thermosensitive recording material according to claim 9, wherein said silver salt is a silver salt of an aliphatic carboxylic acid the aliphatic carbon chain of which contains at least 12 C-atoms.

11. The thermosensitive recording material according to claim 1, wherein a substantially light-insensitive organic silver salt and another layer contains in thermal working relationship with said silver salt one or more reducing agents therefor.

12. A process for direct thermal imaging on a substantially non-photosensitive thermosensitive recording material comprising the steps of:

(i) contacting an information-wise energized heating element with said substantially non-photosensitive thermosensitive recording material, comprising on the same side of a support one or more layers containing in thermal working relationship one or more substances yielding an optical density change by heat; and a protective transparent resin layer consisting essentially of a polycarbonate or copolycarbonate derived from one or more bisphenols, wherein at least 25 mole % of said bisphenols consists of a bis-(hydroxyphenyl)-cycloalkane corresponding to following formula (I):

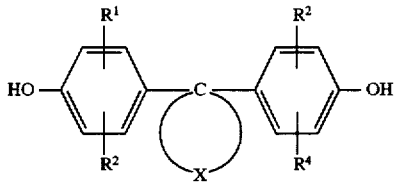

(I)

wherein each of $R^1$, $R^2$, $R^3$, and $R^4$ (same or different) represents hydrogen, halogen, a C1–C8 alkyl group, a substituted C1–C8 alkyl group, a C5–C6 cycloalkyl group, a substituted C5–C6 cycloalkyl group, a C6–C10 aryl group, a substituted C6–C10 aryl group, or a C7–C12 aralkyl group and X represents a plurality of atoms as necessary to complete a 5- to 8-membered alicyclic ring, which either is attached to at least one C1-C6 alkyl group or at least one 5- or 6-membered cycloalkyl group; and (ii) heating said substantially non-photosensitive thermosensitive recording information-wise with said heating element.

13. The process for direct thermal imaging according to claim 12, wherein said alicyclic ring is substituted with two C1–C6 alkyl groups at ring carbon atom(s) two carbon atoms removed from a carbon atom at which said hydroxyghenyl-groups are attached to said alicyclic group.

14. The process for direct thermal imaging according to claim 12, wherein one or more layers contains a substantially light-insensitive organic silver salt in admixture with a reducing agent therefor.

15. The process for direct thermal imaging according to claim 12, wherein said one or more layers contains a substantially light-insensitive organic silver salt and another layer contains in thermal working relationship with said silver salt one or more reducing agents therefore.

16. The process for direct thermal imaging according to claim 12, wherein said protective transparent layer optionally contains a liquid lubricant.

* * * * *

UNITED STATES PATENT AND TRADEMARK OFFICE

CERTIFICATE OF CORRECTION

PATENT NO. :5,759,752
DATED :June 2, 1998
INVENTOR(S) :Carlo Uyttendaele, et al.

It is certified that error appears in the above-identified patent and that said Letters Patent is hereby corrected as shown below:

Col. 3, line 17: "group.," should read -- group, --.

Col. 4, line 67: "Erg" should read -- Erg- --.

Col. 5, line 4: "1973,,page" should read -- 1973, page --;
line 8: "1.5." should read -- 15. --.

Col. 6, line 22: "OH — groups" should read -- OH-groups --;
line 38: "α,α-bis-" should read -- α,α'-bis- --.

Col. 7, line 40: "4v!" should read -- 4" --.

Col. 8, line 10: "PolycarbonatesY," should read -- Polycarbonates", --.

Col. 9, line 17: "Pc3" should read -- PC3 --;
line 43: "The" should read -- ¶The --;
line 48: "The" should read -- ¶The --;
line 52: "Examples" should read -- ¶Examples --;
line 61: "Preferably," should read -- ¶Preferably, --.

Col. 11, line 34: "reflecting." should read -- reflecting --.

Col. 12, line 21: "Suitable" should read -- ¶Suitable --.

Col. 13, line 25: "100pm" should read -- 100μm --.

UNITED STATES PATENT AND TRADEMARK OFFICE

CERTIFICATE OF CORRECTION

PATENT NO. :5,759,752
DATED :June 2, 1998
INVENTOR(S) :Carlo Uyttendaele, et al.

It is certified that error appears in the above-identified patent and that said Letters Patent is hereby corrected as shown below:

Col.14, claim 1, line 13: "substnatially" should read -- substantially --;
claim 2, line 45: "The thermosensitive" should read -- The substantially non photosensitive thermosensitive --;
claim 4, line 55: "The thermosensitive" should read -- The substantially non photosensitive thermosensitive --.

Col. 15, claim 5, line 16: "general" should be deleted;
claim 5, line 21: "OH—" should read -- OH- --;
claim 11, line 49: "The thermosensitive" should read -- The substantially non-photosensitive thermosensitive --.

Col.16, claim 12, line 26: "group" (second occurrence) should read -- group, --

Signed and Sealed this

Twenty-third Day of January, 2001

*Attest:*

*Attesting Officer*

Q. TODD DICKINSON

*Commissioner of Patents and Trademarks*